US009534351B2

(12) United States Patent
Paulos

(10) Patent No.: US 9,534,351 B2
(45) Date of Patent: Jan. 3, 2017

(54) METHOD OF INSTALLING DEPRESSIBLE PAVEMENT MARKER

(75) Inventor: Dean H. Paulos, Pasadena, CA (US)

(73) Assignee: RoadVision Technologies, Inc., Pasadena, CA (US)

( * ) Notice: Subject to any disclaimer, the term of this patent is extended or adjusted under 35 U.S.C. 154(b) by 943 days.

(21) Appl. No.: 12/166,641

(22) Filed: Jul. 2, 2008

(65) Prior Publication Data

US 2010/0003079 A1 Jan. 7, 2010

(51) Int. Cl.
*E01F 9/00* (2016.01)

(52) U.S. Cl.
CPC ..... *E01F 9/571* (2016.02)

(58) Field of Classification Search
CPC ..... E01F 9/571
USPC ..... 404/1–162
See application file for complete search history.

(56) References Cited

U.S. PATENT DOCUMENTS 1,284,283 A 11/1918 Flad
1,410,007 A 3/1922 Downey
1,491,145 A 4/1924 Lange et al.
1,496,811 A 6/1924 Lange et al.
1,777,585 A 10/1930 Springer
1,797,498 A 3/1931 Finley
1,825,667 A 10/1931 Johnson
1,870,994 A 8/1932 George
1,905,612 A 4/1933 Wagner
1,915,032 A * 6/1933 Poulter ..... 404/78
1,933,469 A * 10/1933 Aylward ..... 404/108
1,959,075 A 5/1934 Boatwright
(Continued)

FOREIGN PATENT DOCUMENTS

DE 6803854 3/1969
DE 7323500 4/1973
(Continued)

OTHER PUBLICATIONS

Crafco Inc. Hot-Applied Flexible Pavement Marker Adhesive, Part No. 34270, Jan. 2004, 1 page.*
(Continued)

*Primary Examiner* — Raymond W Addie
(74) *Attorney, Agent, or Firm* — Harness, Dickey & Pierce, P.L.C.

(57) ABSTRACT

A retractable, reflective pavement marker for delineating traffic lanes of roadways and a method of installing the same that provides improved protection from potentially damaging vehicle tires, snowplows, and environmental conditions. The marker incorporates a reflector assembly mounted to a piston that is depressible within a housing. A biasing means returns the reflector assembly to its normal position above the road surface. A compliant adhesive cooperates with an adhesive lock formed between the housing and the opening to ensure that the marker is reliably retained within the pavement. The adhesive and a chamfered opening prevent pavement spalling due to external forces. The housing includes a removable retainer through which the piston is reciprocally received. The retainer includes a plurality of coarsely pitched lead-in threads that cooperate with a threaded housing. Multiple lead-in threads provide sufficient thread engagement, while substantially decreasing the number of rotations to achieve full engagement.

48 Claims, 3 Drawing Sheets

(56) References Cited

U.S. PATENT DOCUMENTS

| | | | | |
|---|---|---|---|---|
| 2,005,170 | A | 6/1935 | Segelhorst | |
| 2,007,457 | A * | 7/1935 | Peters | 404/108 |
| 2,073,968 | A | 3/1937 | Krebs | |
| 2,074,756 | A * | 3/1937 | Poulter | 404/108 |
| 2,127,700 | A | 8/1938 | Rosener | |
| 2,146,359 | A | 2/1939 | Shaw | |
| 2,157,059 | A | 5/1939 | Rosener | |
| 2,192,878 | A | 3/1940 | Beebe | |
| 2,224,554 | A | 12/1940 | Stedman | |
| 2,224,937 | A | 12/1940 | Stedman | |
| 2,229,179 | A | 1/1941 | Langdon | |
| 2,260,498 | A | 10/1941 | Wise | |
| 2,367,146 | A * | 1/1945 | Siebs | 264/34 |
| 2,434,103 | A | 1/1948 | Elliott | |
| 2,489,499 | A | 11/1949 | Pellar | |
| 2,627,784 | A | 2/1953 | Pellar | |
| 2,703,038 | A | 3/1955 | Shaw | |
| 2,941,447 | A | 6/1960 | Abbott, Sr. | |
| 2,974,304 | A | 3/1961 | Nordlund | |
| 2,981,149 | A | 4/1961 | Stolarczyk et al. | |
| 3,067,147 | A | 12/1962 | Rubens et al. | |
| 3,090,042 | A | 5/1963 | Kleist et al. | |
| 3,216,335 | A | 11/1965 | Stolarczyk et al. | |
| 3,257,552 | A | 6/1966 | Converso | |
| 3,292,506 | A | 12/1966 | Kone | |
| 3,343,467 | A | 9/1967 | Bonvallet | |
| 3,371,647 | A | 3/1968 | Shopbell | |
| 3,373,667 | A | 3/1968 | Taylor-Myers | |
| 3,377,930 | A | 4/1968 | Kone | |
| 3,409,344 | A | 11/1968 | Balint et al. | |
| 3,502,008 | A | 3/1970 | Macrae | |
| 3,564,984 | A | 2/1971 | Alexander | |
| 3,703,855 | A | 11/1972 | Converso | |
| 3,717,076 | A | 2/1973 | Shields et al. | |
| 3,771,123 | A | 11/1973 | Lanes | |
| 3,809,487 | A | 5/1974 | Flanagan | |
| 3,850,536 | A | 11/1974 | Kone | |
| 3,874,987 | A | 4/1975 | Young | |
| 3,886,011 | A * | 5/1975 | Eigenmann | 156/71 |
| 3,920,348 | A | 11/1975 | Paulos | |
| 3,921,749 | A | 11/1975 | Kawada et al. | |
| 3,941,633 | A | 3/1976 | Wang et al. | |
| 3,956,779 | A | 5/1976 | Jewett | |
| 4,049,358 | A | 9/1977 | King et al. | |
| 4,050,834 | A | 9/1977 | Lee | |
| 4,088,416 | A | 5/1978 | Taylor et al. | |
| 4,130,370 | A | 12/1978 | Kone | |
| 4,155,666 | A | 5/1979 | Flanagan | |
| 4,194,936 | A | 3/1980 | Martuch | |
| 4,195,945 | A | 4/1980 | Heenan | |
| 4,232,979 | A * | 11/1980 | Johnson et al. | 404/16 |
| 4,290,047 | A | 9/1981 | Latta, Jr. | |
| 4,297,051 | A | 10/1981 | Robinson | |
| 4,304,268 | A | 12/1981 | Gilman | |
| 4,413,923 | A | 11/1983 | Wright et al. | |
| 4,504,169 | A | 3/1985 | Jones et al. | |
| 4,515,499 | A | 5/1985 | Furiate | |
| 4,590,471 | A | 5/1986 | Pieroway et al. | |
| 4,595,312 | A | 6/1986 | Corless et al. | |
| 4,597,691 | A | 7/1986 | Clarke et al. | |
| 4,621,015 | A | 11/1986 | Long et al. | |
| 4,668,120 | A | 5/1987 | Roberts | |
| 4,685,824 | A | 8/1987 | Eigenmann et al. | |
| 4,687,691 | A | 8/1987 | Kay | |
| 4,694,296 | A | 9/1987 | Sasaki et al. | |
| 4,737,049 | A | 4/1988 | Callhan | |
| 4,955,982 | A | 9/1990 | Paulos | |
| 5,074,706 | A | 12/1991 | Paulos | |
| 5,302,048 | A | 4/1994 | Paulos et al. | |
| 5,501,545 | A * | 3/1996 | Walter | 404/14 |
| 6,102,612 | A * | 8/2000 | Pricone et al. | 404/13 |
| 6,558,071 | B1 * | 5/2003 | Sproules | 404/78 |
| 6,976,804 | B1 * | 12/2005 | Asplin | 404/78 |
| 7,011,470 | B1 * | 3/2006 | Breazeale et al. | 404/11 |
| 7,249,911 | B2 * | 7/2007 | Hyams | 404/15 |
| 7,524,137 | B2 * | 4/2009 | Obedzinski | 404/72 |

FOREIGN PATENT DOCUMENTS

| | | |
|---|---|---|
| FR | 771693 | 10/1934 |
| GB | 383527 | 11/1932 |
| GB | 436290 | 10/1935 |
| GB | 529086 | 11/1940 |
| GB | 545039 | 5/1942 |
| GB | 648542 | 1/1951 |
| GB | 738993 | 10/1955 |
| GB | 965583 | 7/1964 |
| GB | 1018831 | 2/1966 |
| GB | 1103505 | 2/1968 |
| GB | 2121463 | 12/1983 |
| IT | 502023 | 11/1954 |
| KR | 20-0275966 | 5/2002 |
| KR | 20030066192 | 8/2003 |
| WO | WO-8807606 | 10/1988 |
| WO | WO-9316233 | 8/1993 |
| WO | WO 99/36629 | 7/1999 |

OTHER PUBLICATIONS

"Evaluation of Snowplowable Markers" by Jerry G. Pigman and Kenneth R. Agent, Kentucky Transportation Research Program, University ofKentucky, May 1982.

"Evaluation of Recessed, Snowplowable Markers for Centerline Delineation" by Frank D. Shepard, Virginia Highway & Transportation Research Council, Jul. 1979.

"Evaluation Report—Experimental Snowplowable Retroreflective Pavement Marking Systems", West Virginia Department of Highways, Traffic Engineering Division, Jan. 11, 1986.

"Evaluation of Snowplowable Raised Reflective Pavement Markers in New Jersey", by M. V. Jagannath and A. W. Roberts, Bureau of Operations Research Division of Research and Development New Jersey Department of Transportation, Nov. 1976.

"Depressable Raised Pavement Marker Preliminary Field Test Report" by Angelo A. Mendola, New Jersey Department of Transportation, Nov. 1987.

Memorandum "Raised Pavement Markings", John G. Bestgen, U.S. Department of Transporation Federal Highway Administration, May 2, 1988.

* cited by examiner

METHOD OF INSTALLING DEPRESSIBLE PAVEMENT MARKER

FIELD

The present disclosure relates to depressible, reflective pavement markers for delineating the traffic lanes on roadways, and to a method of installing the pavement markers into a roadway that minimizes damage due to common external forces.

BACKGROUND

The statements in this section merely provide background information related to the present disclosure and may not constitute prior art.

The benefits of roadway lane markers to delineate traffic paths for drivers are unquestioned. Reflective pavement markers are more desirable than the usual painted dividing lines because such reflective markers can be seen over a greater distance and are easier to see in poor light or weather conditions such as rain, snow or fog.

Depressible pavement markers are more desirable than rigid, surface mounted markers because they are resistant to damaging impacts and shearing forces caused by vehicle tires and snowplow blades. Retractable markers have been developed to minimize damage to the reflectors. Although it protrudes above the road surface, the retractable marker may be depressed by a blow from a snowplow blade or vehicle tire. Typically, a beveled upper surface formed on the reflector protrusion provides an inclined plane across which the blade or tire rides, deflecting the protruding reflector portion of the marker downwardly into its housing. The retractable marker may include a removable retainer to enable maintenance without having to remove the entire assembly.

SUMMARY

The present invention comprises improvements to prior known pavement markers and a method of installing a resilient pavement marker able to withstand the forces of traffic and snowplows that allows for simple repair in the event of damage to the marker.

The resilient pavement marker of the present invention includes a housing, which may be securely imbedded within an opening in the pavement, a piston which carries a replaceable reflector assembly, and resilient biasing means urging the piston upwardly to raise the reflector assembly above the road surface. A retainer threadably engages the housing and cooperates therewith to enclose the piston and biasing means. The retainer has an aperture through which the piston may extend to raise the reflector assembly.

An adhesive bonds the housing within the opening in the pavement. An outer surface of the housing and a circumferential surface of the opening are contoured, and cooperate with each other to form a mechanical adhesive lock. The adhesive lock strengthens the bonding ability of the adhesive and prevents road traffic impacts and vibrations from extracting the housing. In a preferred embodiment, the adhesive is compliant and energy absorbing, to mitigate spalling around the edge of the opening in the pavement. The opening may also include a chamfer at the pavement surface to further reduce pavement spalling.

The retainer may include a plurality of lead-in threads. The pitch of the threads may be substantially coarser than prior known markers. The plurality of lead-in threads provides for sufficient thread engagement while substantially decreasing the number of rotations required to fully fasten the retainer to the housing, thereby facilitating quick and easy maintenance.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
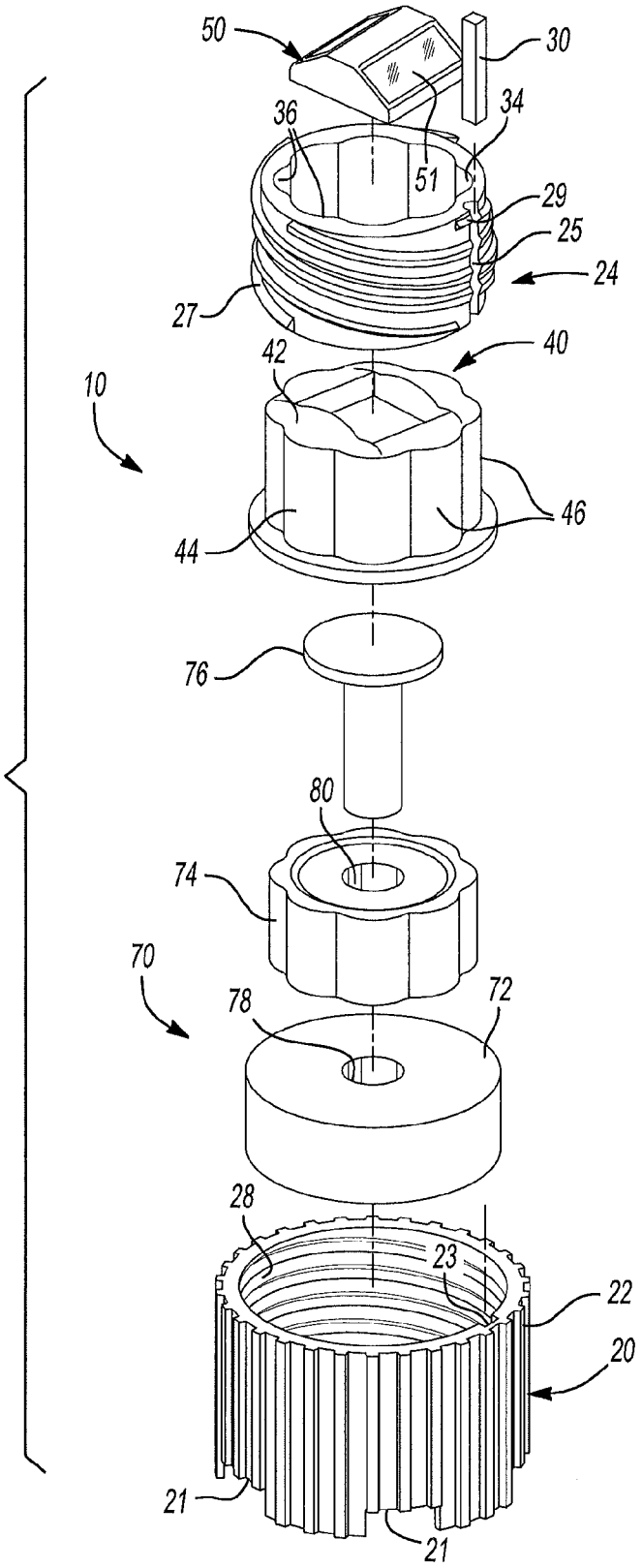
FIG. 1 is an exploded view of a resilient pavement marker.

The following description is merely exemplary in nature and is not intended to limit the present disclosure, application, or uses. It should be understood that throughout the drawings, corresponding reference numerals indicate like or corresponding parts and features.

Figure 2:
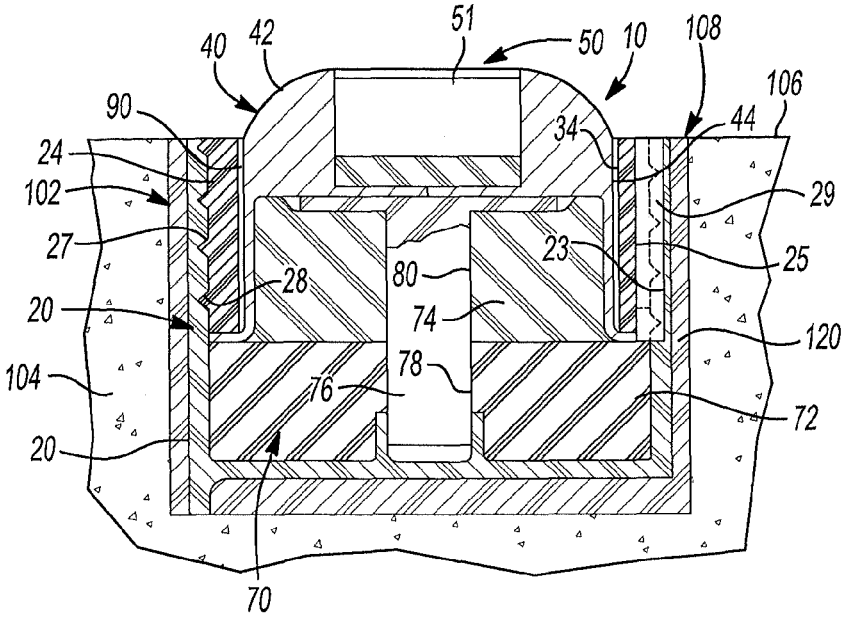
FIG. 2 is cross-sectional view of the marker of FIG. 1, imbedded within a roadway according to the principles of the present disclosure.
Figure 3:
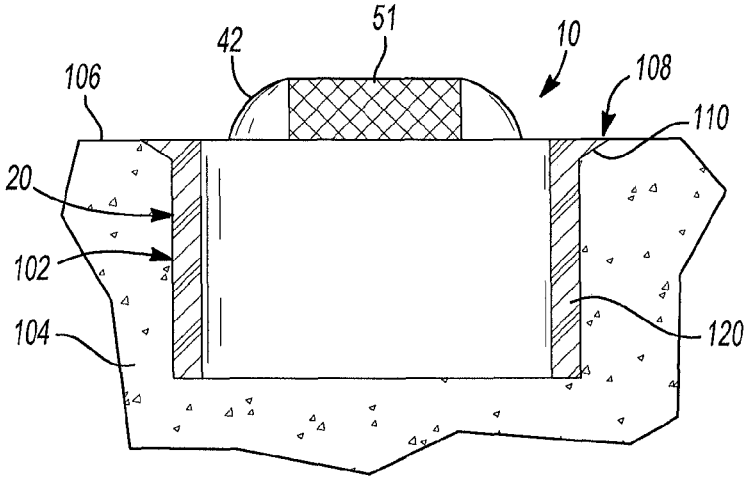
FIG. 3 is a cross-sectional view of a marker imbedded in a pavement opening.

Referring first to FIGS. 1 and 2, there is shown a reflective pavement marker 10 embodying the present invention and adapted to be fixedly mounted within an opening 102, formed within pavement 104, as will be subsequently described. The pavement 104 comprises a road surface 106. The marker 10 is intended to delineate traffic lanes of the road surface 106 in a highly visible manner.

The marker 10 broadly comprises a housing 20, a piston 40 reciprocally received within the housing 20, a reflector assembly 50 mounted to piston 40, and resiliently compressible biasing means 70 permitting depression of the piston 40 within the housing 20 in response to surface traffic forces while ensuring return of piston 40 to its normal position. The resilient pavement marker 10 of the present disclosure provides effective reflecting to delineate traffic lanes, and is capable of withstanding the impact of vehicle tires and snowplow blades by retracting into the road surface 106.

A retainer 24 is threadably received within housing 20. Retainer 24 includes a plurality of lead-in threads 27. After lead-in threads 27 are initially mated with cooperating threads 28 of housing 20, retainer 24 may be rotated 540 degrees along cooperating threads 28 to fully threadably engage with housing 20. Stated another way, one and one half rotations may be sufficient to fully threadably engage retainer 24 within housing 20. One of ordinary skill in the art will appreciate that the number of rotations of retainer 24 within housing 20 necessary to fully engage retainer 24 therein may be more or less than one and one half rotations. Although FIG. 1 depicts the retainer 24 having four lead-in threads 27, one or ordinary skill in the art will appreciate that the retainer 24 could have any number of lead-in threads 27.

Multiple lead-in threads 27 ensure the retainer 24 is sufficiently engaged with housing to withstand road traffic forces, while minimizing the number of rotations along cooperating threads 27, 28. The pitch and depth of the threads 27, 28 may be customized for a given application and may be based on several factors, such as the materials of the housing 20 and the retainer 24, the manufacturing tolerances thereof, an acceptable number of turns required to fully engage the cooperating threads 27, 28, and/or any other relevant parameters.

One of the plurality of lead-in threads 27 may be an alignment thread 29 having a different geometric configuration than the remaining one or more lead-in threads 27. For example, the alignment thread 29 may be larger or smaller and/or have a different cross-sectional shape than the remaining one or more lead-in threads 27. One of the plurality of mating threads 28 can be similarly configured to threadably engage the alignment thread 29. In this manner, the plurality of lead-in threads 27 can only engage the mating threads 28 in such a manner as to place the retainer 24 and housing 20 in an appropriate orientation relative to each other.

Retainer 24 must be properly aligned within housing 20 in order for reflector assembly 50 to be properly oriented relative to road surface 106. Housing 20 and retainer 24 may include grooves 23 and 25, respectively. The alignment thread 29 can be disposed on the retainer 24 such that engagement with its corresponding mating thread 28 will place the retainer 24 in its proper orientation relative to the housing 20, thereby appropriately orienting the reflective lenses 51 relative to the roadway and appropriately orienting the grooves 23, 25 relative to each other. Once retainer 24 is fully threadably engaged within housing 20 and grooves 23, 25 are rotationally aligned, a pin 30 may be inserted into the grooves 23, 25. Once received in grooves 23, 25, the pin 30 prevents retainer 24 from rotating relative to housing 20. As a result, road traffic forces cannot threadably disengage retainer 24 from housing 20.

The retainer 24 is in the form of a sleeve with an upper aperture 34 through which the piston 40 extends. In a preferred embodiment of the present invention, the upper aperture 34 includes a plurality of lobes 36 to maintain rotational alignment of piston 40 relative to retainer 24. The piston 40 is reciprocally received within retainer 24 such that an upper end 42 of piston 40 extends above the retainer 24 and the pavement surface 106. Piston 40 includes a lobed peripheral surface 44 with lobes 46 that cooperate with lobes 36 of retainer 24. This configuration allows piston 40 to reciprocate within retainer 24, while preventing rotation within housing 20.

The reflector assembly 50 may be mounted to the upper end 42 of piston 40 in order to provide reflective delineation above the pavement surface 106 under normal operating conditions. The upper end 42 shields one or more reflective lenses 51 from otherwise potentially damaging impacts from a snow plow or other vehicle, for example. The reflective lenses 51 may be disposed at about a 30 degree angle relative to the surface of the road. The reflector assembly 50 can be configured substantially as shown in FIG. 1, or as described in U.S. Pat. No. 5,302,048, for example, or any other suitable configuration.

The resiliently compressible biasing means 70 allows depression of the piston 40 into the housing 20 in response to external forces such as vehicle tires or snowplow blades, yet returns the piston 40 and reflector assembly 50 to their normal reflective position to provide delineation of traffic lanes. In a preferred embodiment, the biasing means 70 comprises a lower compression member 72, an upper compression member 74 and a center rebound spool 76. The spool 76 extends through axial throughbores 78 and 80 formed in the lower compression member 72 and upper compression member 74, respectively. The lower compression member 72 fills substantially all of the space within the housing 20 below retainer 24 while the upper compression member 74 fills substantially all the space within the piston 40 thereby minimizing any empty space within which moisture, ice and debris may accumulate. It should be appreciated that the resiliently compressible biasing means 70 may be otherwise suitably configured.

When piston 40 is compressed, the lower compression member 72 and the upper compression member 74 are compressed against each other, evacuating the small amount of air that exists between them. This creates an air flow through a passage 90 between the lobed peripheral surface 44 of piston 40 and the upper aperture 34 of retainer 24. This air flow purges moisture and debris that is able to accumulate within the housing 20.

Referring now to FIGS. 2-7, the pavement marker 10 is shown imbedded in the pavement 104. In a preferred method of installation, marker 10 is installed as an assembled unit into opening 102. Alternatively, housing 20 may be independently installed into opening 102 before the remaining components of marker 10 are assembled into housing 20.

Opening 102 is drilled in pavement 104 and a chamfer 110 may be formed on the peripheral edge 108 of the opening 102 to reduce or eliminate spalling. A compliant adhesive 120 may then be applied within the opening 102. Housing 20 may then be inserted into opening 102 such that the adhesive 120 fixedly bonds the housing 20 therein. It should be appreciated that an alternative method of installation could include inserting the housing 20 into the opening 102 before the adhesive 120 and subsequently applying the adhesive 120 around the housing 20.

The adhesive 120 may substantially fill the gap between the outer diameter of the housing 20 and the inner diameter of the opening 102, thereby forming a moisture impervious seal around the housing 20. A plurality of cut-outs 21 may be disposed around the bottom of the outer diameter of the housing 20 (FIGS. 1 and 2). The cut-outs 21 facilitate the flow of adhesive 120 from beneath the housing 20 around the outer diameter of the housing 20. The outer diameter of the housing 20 may also include a plurality of longitudinally extending ribs 22 (FIG. 1) to facilitate bonding of the housing 20 within the opening 102 and reduce or eliminate undesirable rotation of the housing 20 within the opening 102.

The compliant adhesive 120 can be a bituminous adhesive. The compliant adhesive 120 may be sufficiently compliant and compressible to absorb external impact shock and vibration, reducing spalling of the peripheral edge 108 of opening 102. Presently preferred adhesives include BERAM 195 (McAsphalt Industries), FLEXIBLE MARKER ADHESIVE 34270 (CRAFCO, INC.), an equivalent of these adhesives, or any other adhesive with similar specifications or characteristics. The adhesive 120 may be selected to suit the construction of the marker 10, the opening 102, the gap therebetween, and environmental conditions of the roadway in which the marker 10 will be installed. The adhesive may harden when exposed to colder temperatures. Accordingly, for a marker installed in a cold climate, the adhesive may be softer at room temperature than the adhesive used in a warmer climate.

The compliant adhesive 120 fills an adhesive lock 130 formed between a contoured outer surface 132 of housing 20 and/or a contoured circumferential surface 134 of opening 102. A contoured surface, according to the present invention, is a surface comprising a revolved profile; wherein the profile includes a plurality of directional changes. This configuration provides retention and adhesion properties that are superior to those of a simply flared housing or opening. The contoured outer surface 132 and/or a contoured circumferential surface 134 surround the adhesive 120, mechanically reinforcing the bond between housing and opening 102. Further, the adhesive lock 130 has more surface area to which the adhesive 120 may bond than a marker with a straight or tapered housing. Thus, the adhesive lock 130 prevents external forces, such as impact shock or vibration, from extracting the housing 20 from the opening 102.

Figure 4:
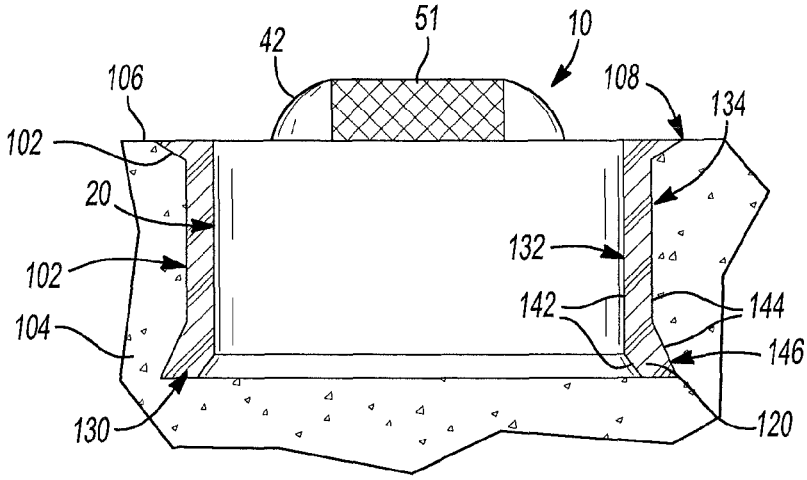
FIG. 4 is a cross-sectional view of an imbedded marker according to the present disclosure.
Figure 5:
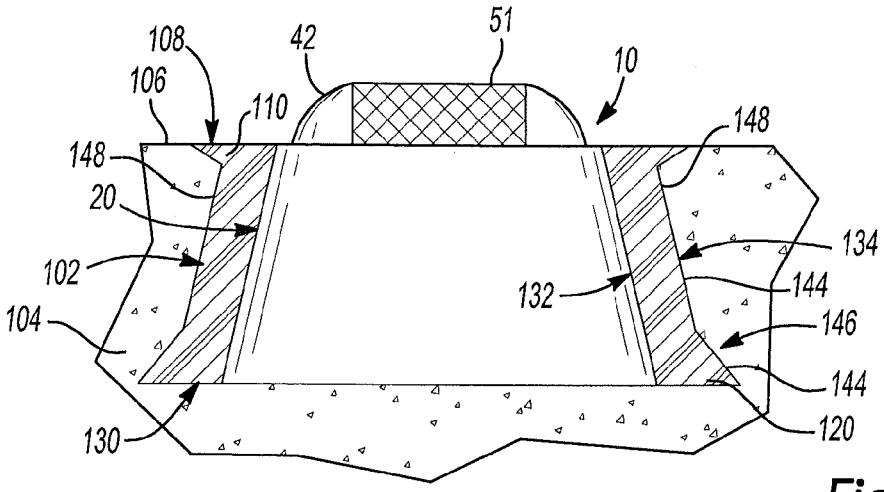
FIG. 5 is a cross-sectional view of an another embodiment of the imbedded marker.
Figure 6:
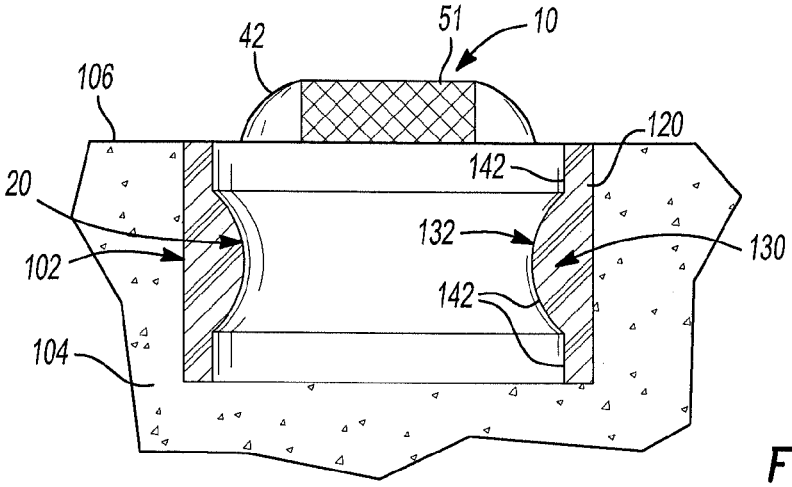
FIG. 6 is a cross-sectional view of yet another embodiment of the imbedded marker.
Figure 7:
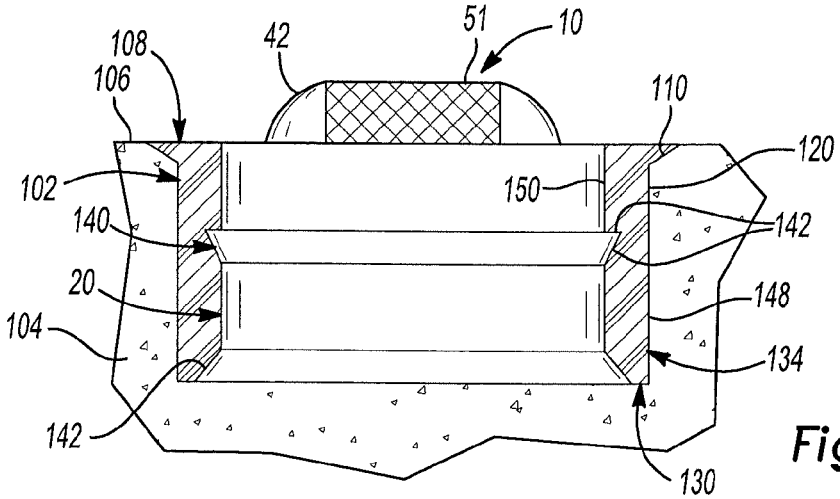
FIG. 7 is a cross-sectional view of still another embodiment of the imbedded marker.

The contoured outer surface 132 of housing 20 may include a plurality of facets 142, as shown in FIGS. 4, 6 and 7. The plurality of facets 142 may form a barb protuberance 140 (FIG. 7). Similarly, contoured circumferential surface 134 of opening 102 may also include a plurality of facets 144, forming an undercut 146. Another embodiment includes a tapered circumferential surface 148 of opening 102 and/or a tapered outer surface 150 of the housing 20. These tapered surfaces 148, 150 cooperate with the retention properties of the adhesive lock 130 to further enhance adhesion and the integrity of the bond between housing 20 and opening 102.

The improved reliability and effectiveness of the pavement marker 10 of the present invention provides substantial cost savings in maintaining reflective traffic lanes and the roadway 106. The adhesive lock 130 ensures marker 10 is reliably secured into the pavement 104. The compliant adhesive 120 and the chamfered periphery 110 of opening 102 minimize pavement spalling. As a vehicle tire or snowplow blade impacts the marker 10, the reflector assembly 50 mounted to piston 40 is depressed into the housing 20. The subsequent compression of lower compression member 72 and upper compression member 74 forces a pulse of air through passage 90 to evacuate any moisture and/or debris that may have accumulated within the marker 10. These features reduce the demand for maintenance to the marker 10 and the surrounding roadway 106. The removable retainer 24 with multiple lead-in threads 27 enable quick and easy maintenance, should any be required.

The description of the invention is merely exemplary in nature; therefore, variations that do not depart from the gist of the invention are intended to be within the scope of the invention. Such variations are not to be regarded as a departure from the spirit and scope of the invention.

What is claimed is:

1. A depressible pavement marker installation comprising:

a road surface having an opening with a chamfered peripheral edge formed thereon;

a housing resiliently mounted with a compliant adhesive in said opening such that an upper end of said housing is positioned at or below said road surface, the adhesive being resiliently compliant after being fully cured within the opening;

a retainer threadably engaged with said housing;

a piston reciprocally movable within said housing, said piston including an upper end normally protruding above said housing and said road surface, said piston being depressible downwardly in said housing to move said upper end of said piston into said housing;

a reflector assembly mounted to said upper end of said piston such that said reflector assembly is normally positioned above said road surface; and resiliently compressible means biasing said piston upwardly to raise said upper end of said piston above said housing and said road surface, said biasing means substantially filling the interior of the housing.

2. The depressible pavement marker according to claim 1, wherein one and one half rotations is sufficient to fully threadably engage said retainer to said housing.

3. The depressible pavement marker according to claim 1, wherein said plurality of lead-in threads includes an alignment thread to facilitate alignment of said retainer relative to said housing.

4. The depressible pavement marker according to claim 1, wherein compression of said piston forces air through a passage to evacuate moisture and debris.

5. The depressible pavement marker according to claim 1, wherein said retainer includes a plurality of lead-in threads.

6. The depressible pavement marker according to claim 1, wherein a circumferential surface of said opening includes an undercut.

7. The depressible pavement marker according to claim 1, wherein said opening includes a first diameter at said road surface and a second diameter at a bottom surface of said opening.

8. The depressible pavement marker according to claim 7, wherein said second diameter is greater than said first diameter.

9. The depressible pavement marker according to claim 7, wherein said first diameter is greater than said second diameter.

10. The depressible pavement marker according to claim 7, wherein an outer surface of said housing is parallel to said circumferential surface of said opening.

11. The depressible pavement marker according to claim 7, wherein an outer surface of said housing is angled relative to at least a portion of said circumferential surface of said opening.

12. The depressible pavement marker according to claim 1, wherein said housing includes a plurality of outer surfaces disposed at a plurality of respective angles relative to said road surface.

13. The depressible pavement marker according to claim 12, wherein said housing includes a first outer surface disposed at a first angle relative to said pavement surface, and a second outer surface disposed at a second angle relative to said road surface.

14. The depressible pavement marker according to claim 1, wherein said retainer and said housing include locating features to ensure proper orientation of said reflector assembly.

15. The depressible pavement marker according to claim 14, wherein said locating features are holes and a pin is received through said holes.

16. The depressible pavement marker according to claim 1, wherein said compliant adhesive is a bituminous adhesive.

17. The depressible pavement marker according to claim 1, wherein said compliant adhesive forms a moisture impervious seal between said housing and said opening.

18. A method of installing a pavement marker comprising:

forming an opening in a road surface along a longitudinal axis, said opening having a side wall and an end wall, a contoured portion of said side wall being angularly oriented with respect to said longitudinal axis;

inserting a compliant adhesive into said opening; and inserting a housing within said opening, said compliant adhesive bonding said housing within said opening, the compliant adhesive remaining compliant after being fully cured, thereby forming a resilient, moisture impervious seal, wherein said compliant adhesive fills an adhesive lock formed between an outer surface of said housing and said contoured portion of said side wall.

19. The method of installing a pavement marker according to claim 18 further comprises forming a chamfered periphery in said opening at said road surface.

20. The method of installing a pavement marker according to claim 18, wherein said compliant adhesive is a bituminous adhesive.

21. The method of installing a pavement marker according to claim 18, wherein said contoured outer surface includes a plurality of facets.

22. The method of installing a pavement marker according to claim 18, wherein said adhesive lock is a barb protuberance formed on said outer surface of said housing.

23. The method of installing a pavement marker according to claim 18, wherein said adhesive lock is an undercut formed in said opening.

24. The method of installing a pavement marker according to claim 18, wherein said opening is formed to include a first diameter at said road surface and a second diameter at a bottom surface of said opening.

25. The method of installing a pavement marker according to claim 24, wherein said first diameter is greater than said second diameter.

26. The method of installing a pavement marker according to claim 24, wherein said second diameter is greater than said first diameter.

27. The method of installing a pavement marker according to claim 18, wherein a retainer with a plurality of lead-in threads is threadably engaged with said housing.

28. The method of installing a pavement marker according to claim 27, wherein said plurality of lead-in threads includes an alignment thread to facilitate alignment of said retainer relative to said housing.

29. The method of installing a pavement marker according to claim 27, wherein one and one half rotations is sufficient to fully engage said retainer to said housing.

30. The method of installing a pavement marker according to claim 18, wherein a pin is inserted into said retainer and said housing to fixedly align said retainer and said housing.

31. A method of installing a pavement marker comprising:

drilling an opening into a road surface;

forming a chamfered periphery in said opening at said road surface to prevent spalling;

injecting a compliant adhesive into said opening;

inserting a housing into said opening; and bonding said housing within said opening, said compliant adhesive remaining compliant after being fully cured and forming a resilient, moisture impervious seal.

32. The method of installing a pavement marker according to claim 31, wherein the step of injecting a compliant adhesive into said opening is performed prior to inserting said housing into said opening.

33. The method of installing a pavement marker according to claim 31, wherein said compliant adhesive is a bituminous adhesive.

34. The method of installing a pavement marker according to claim 31, wherein said compliant adhesive fills an adhesive lock formed between a circumferential surface of said opening and an outer surface of said housing.

35. The method of installing a pavement marker according to claim 34, wherein said outer surface and/or said circumferential surface is contoured to prevent extraction of said housing from said opening.

36. The method of installing a pavement marker according to claim 35, wherein said contoured outer surface includes a plurality of facets.

37. The method of installing a pavement marker according to claim 36, wherein said adhesive lock is a barb protuberance formed on said outer surface of said housing.

38. The method of installing a pavement marker according to claim 34, wherein said adhesive lock is an undercut formed in said opening.

39. The method of installing a pavement marker according to claim 31, wherein said opening is drilled to include a first diameter at said road surface and a second diameter at a bottom surface of said opening.

40. The method of installing a pavement marker according to claim 39, wherein said first diameter is greater than said second diameter.

41. The method of installing a pavement marker according to claim 39, wherein said second diameter is greater than said first diameter.

42. The method of installing a pavement marker according to claim 31, wherein a retainer with a plurality of lead-in threads is threadably engaged with said housing.

43. The method of installing a pavement marker according to claim 42, wherein said plurality of lead-in threads includes an alignment thread to facilitate alignment of said retainer relative to said housing.

44. The method of installing a pavement marker according to claim 42, wherein one and one half complete rotations are sufficient to fully engage said retainer to said housing.

45. The method of installing a pavement marker according to claim 31, wherein a pin is inserted into said retainer and said housing to fixedly align said retainer and said housing.

46. A pavement marker installation comprising:

a housing resiliently mounted within an opening formed in a road surface;

an adhesive disposed in an annular gap between at least a portion of a sidewall formed by said opening and at least a portion of a periphery of said housing, said adhesive being resiliently compliant after being fully cured within said opening;

a piston reciprocally movable within said housing, said piston including an upper end normally protruding above said housing and said road surface, said piston being depressible downwardly in said housing to move said upper end of said piston into said housing;

a reflector assembly mounted to said upper end of said piston such that said reflector assembly is normally positioned above said road surface; and a compression member biasing said piston upwardly to raise said upper end of said piston above said housing and said road surface.

47. The depressible pavement marker according to claim 46, further comprising a retainer threadably engaged with said housing, said retainer including a plurality of lead-in threads.

48. The depressible pavement marker according to claim 46, wherein said opening includes a chamfered periphery.

* * * * *